US009063489B2

(12) United States Patent
Nanjo

(10) Patent No.: US 9,063,489 B2
(45) Date of Patent: Jun. 23, 2015

(54) FIXING DEVICE AND IMAGE FORMING APPARATUS

(71) Applicant: KYOCERA Document Solutions Inc., Osaka (JP)

(72) Inventor: Yuzuru Nanjo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/229,053

(22) Filed: Mar. 28, 2014

(65) Prior Publication Data

US 2014/0294468 A1 Oct. 2, 2014

(30) Foreign Application Priority Data

Mar. 29, 2013 (JP) ..... 2013-071349

(51) Int. Cl.
*G03G 15/20* (2006.01)

(52) U.S. Cl.
CPC ..... *G03G 15/2053* (2013.01); *G03G 15/2057* (2013.01)

(58) Field of Classification Search
USPC ..... 399/329
See application file for complete search history.

(56) References Cited

U.S. PATENT DOCUMENTS

| | | | | |
|---|---|---|---|---|
| 6,137,983 | A * | 10/2000 | Okabayashi et al. | 399/329 |
| 7,317,893 | B2 * | 1/2008 | Maeda | 399/333 |
| 2013/0287460 | A1 * | 10/2013 | Kitagawa | 399/333 |

FOREIGN PATENT DOCUMENTS

| | | | |
|---|---|---|---|
| JP | 08-129313 | A | 5/1996 |
| JP | 2005-345850 | A | 12/2005 |
| JP | 2007-279671 | A | 10/2007 |

* cited by examiner

*Primary Examiner* — Clayton E LaBalle
*Assistant Examiner* — Warren K Fenwick
(74) *Attorney, Agent, or Firm* — Studebaker & Brackett PC

(57) ABSTRACT

A fixing device includes a fixing belt, a heating source and a fixing roller. The fixing belt has a sheet passing part and a non-sheet passing part. The fixing roller includes an elastic layer including first and second elastic parts. The first elastic part is provided on an inner diameter side of the sheet passing part. The second elastic part is provided on an inner diameter side of the non-sheet passing part. A gap is formed between a part of the elastic layer and the fixing belt in a state where the fixing belt is not heated. The part of the elastic layer is in close contact with the fixing belt in a state where the fixing belt is heated. The first elastic part includes a small-diameter part having a smaller external diameter than a part with a maximum external diameter of the second elastic part.

18 Claims, 8 Drawing Sheets

A : a case where there is a gap between a fixing roller and a fixing belt

B : a case where a fixing roller comes into pressure contact with a fixing belt

FIXING DEVICE AND IMAGE FORMING APPARATUS

INCORPORATION BY REFERENCE

This application is based on and claims the benefit of priority from Japanese Patent application No. 2013-071349 filed on Mar. 29, 2013, the entire contents of which are incorporated herein by reference.

BACKGROUND

The present disclosure relates to a fixing device to fix a toner image on a recording medium, such as a sheet or a film, and an image forming apparatus provided with the fixing device.

An electrographic image forming apparatus, such as a copying machine and a printer, is provided with a fixing device to fix the toner image on the recording medium, such as the sheet or the film. For a method of fixing the toner image on the recording medium, a heat fixing manner is generally applied to fuse a toner (a developer) by heating. To the fixing device applying the heat fixing manner, a heat roller system is often applied from a point of view of thermal efficiency and safety. Meanwhile, the heat roller system is a system which forms a fixing nip to fix the toner image on the recording medium, with a fixing roller and a pressing roller.

The heat roller system usually applies a configuration of forming the fixing roller with a hollow core bar whose material is, for example, aluminum. A halogen lamp is located inside the fixing roller to generate heat and to heat the fixing roller to a predetermined temperature. However, this system has a problem that the temperature of the fixing roller starts to rise slowly and a warm-up time becomes long.

Hence, the warm-up time may be shortened by reducing the thickness of the fixing roller and reducing a heat capacity. Then, deflection of the fixing roller becomes significant. Accompanying with this, a pressure of a center part of the fixing nip becomes weaker than pressures of both end parts of the fixing nip and fixing failure may be caused. Therefore, there is a limit to reduce the heat capacity of the fixing roller.

To solve such a problem, there is a fixing device provided with a fixing roller including a core bar and an elastic layer, a fixing belt provided around the fixing roller, and a heating source to heat the fixing belt from an outside.

By the way, in the fixing device applying such a configuration, the elastic layer of the fixing roller and the fixing belt are generally adhered by an adhesive. However, when the adhesive is used to fix the elastic layer of the fixing roller to the fixing belt, heat generated in the fixing belt escapes to an adhesive layer. Therefore, there are problems that a warm-up time becomes long and it takes time to heat the fixing belt from a standby temperature to a predetermined temperature.

Hence, there is a configuration that the fixing roller and the fixing belt are not adhered with each other and a slight gap is formed between the fixing roller and the fixing belt. There is also a configuration that an external diameter of the fixing roller becomes larger than an inner diameter of the fixing belt by thermal expansion of the fixing roller.

However, according to the configuration that the slight gap between the fixing roller and the fixing belt, when the fixing nip is formed by bringing the fixing belt and the pressing roller into pressure contact with each other, a track of the fixing belt changes from a nearly precise circular shape to an elliptical shape. As a result, when, for example, a non-contact temperature sensor is located around the fixing belt, an interval between the temperature sensor and the fixing belt changes, and a detection value of the temperature sensor becomes inaccurate. Further, when, for example, a thermostat as safety equipment is located around the fixing belt, an interval between the thermostat and the fixing belt changes, and the thermostat does not actuate at an adequate timing. For example, a so-called "early actuation" which causes the thermostat to actuate earlier than an adequate timing occurs. Further, when the fixing belt contacts peripheral members, such as the temperature sensor and the thermostat, a surface layer of the fixing belt may be damaged. Accompanying with this, it is feared that an abnormal image occurs or the fixing belt breaks. Furthermore, when an IH coil as the heating source is located outside of the fixing belt, an interval between the IH coil and the fixing belt changes and heat generation efficiency of the fixing belt is likely to decrease.

By contrast, according to the configuration that an external diameter of the fixing roller becomes larger than an inner diameter of the fixing belt by thermal expansion of the fixing roller, the fixing belt is supported from an inside by the fixing roller, so that it is possible to stabilize a track of the fixing belt.

However, the thermally expanded fixing roller comes into pressure contact with the fixing belt, and an internal pressure of the fixing belt rises and apparent hardnesses of the fixing roller and the fixing belt increase. Accompanying with this, a width of the fixing nip (hereinafter, referred to as a "nip width") decreases. To obtain an adequate nip width despite the rise of the apparent hardnesses of the fixing roller and the fixing belt, a pressure of the fixing nip (hereinafter, referred to as a "fixing pressure") needs to be set higher than a case where there is a gap between the fixing roller and the fixing belt (see FIG. 8). When the fixing pressure is set high, a significant load is applied to the core bar of the fixing roller. The external diameter of the core bar of the fixing roller needs to be set larger to prevent the core bar of the fixing roller from significantly deflecting even when a significant load is applied as described above. Accompanying with this, the external diameter of the elastic layer of the fixing roller also becomes large. When the diameter of the elastic layer of the fixing roller becomes large as described above, the diameter of the fixing belt also becomes large and a heat capacity and a radiation amount of the fixing belt increase, and therefore heat loss increases.

Further, as the internal pressure of the fixing belt rises as described above, a stress is constantly applied to the elastic layer of the fixing roller in use. Therefore, the fixing roller is heavily deteriorated, and a life cycle of the fixing roller needs to be set short. Deterioration of the fixing roller described herein means that, for example, the external diameter of the fixing roller decreases because a cell wall of the elastic layer of the fixing roller is crashed or the cell wall of the elastic layer of the fixing roller is torn. This phenomenon is more remarkable in a center part of the fixing roller than both end parts of the fixing roller in the rotation axis direction of the fixing roller. This is because the radiation amount of the center part of the fixing roller is lower than radiation amounts of the both end parts of the fixing roller, and thermal stress is greater. Further, the circumference of the center part of the fixing roller is trapped by the both end parts of the fixing roller, and the center part of the fixing roller deforms such that a cell is crashed and the volume of the elastic layer decreases. Furthermore, the above phenomenon is significant in a boundary surface between the core bar and the elastic layer in a radial direction of the fixing roller. This is because a stress concentrates on the boundary surface between the core bar and the elastic layer.

SUMMARY

In accordance with an embodiment of the present disclosure, a fixing device includes a fixing belt, a heating source and a fixing roller. The fixing belt is provided rotatably. The fixing belt has a sheet passing part and a non-sheet passing part. A recording medium passes through the sheet passing part. The non-sheet passing part is provided on an outer side of the sheet passing part in a rotation axis direction of the fixing belt. The heating source is configured to heat the fixing belt to a fixing temperature at which a toner image is fixed on the recording medium. The fixing roller is inserted in the fixing belt. The fixing roller includes an elastic layer having a higher linear expansion coefficient than a linear expansion coefficient of the fixing belt. The elastic layer includes a first elastic part and a second elastic part. The first elastic part is provided on an inner diameter side of the sheet passing part. The second elastic part is provided on an outer side of the first elastic part in the rotation axis direction of the fixing belt and provided on an inner diameter side of the non-sheet passing part. A gap is formed between at least a part of the elastic layer and the fixing belt in a state where the fixing belt is not heated by the heating source. At least the part of the elastic layer is in close contact with the fixing belt by thermal expansion in a state where the fixing belt is heated to the fixing temperature by the heating source. The first elastic part includes a small-diameter part having a smaller external diameter than a part with a maximum external diameter of the second elastic part.

In accordance with an embodiment of the present disclosure, an image forming apparatus includes a fixing device. The fixing device includes a fixing belt, a heating source and a fixing roller. The fixing belt is provided rotatably. The fixing belt has a sheet passing part and a non-sheet passing part. A recording medium passes through the sheet pas sing part. The non-sheet passing part is provided on an outer side of the sheet passing part in a rotation axis direction of the fixing belt. The heating source is configured to heat the fixing belt to a fixing temperature at which a toner image is fixed on the recording medium. The fixing roller is inserted in the fixing belt. The fixing roller includes an elastic layer having a higher linear expansion coefficient than a linear expansion coefficient of the fixing belt. The elastic layer includes a first elastic part and a second elastic part. The first elastic part is provided on an inner diameter side of the sheet passing part. The second elastic part is provided on an outer side of the first elastic part in the rotation axis direction of the fixing belt and provided on an inner diameter side of the non-sheet passing part. A gap is formed between at least a part of the elastic layer and the fixing belt in a state where the fixing belt is not heated by the heating source. At least the part of the elastic layer is in close contact with the fixing belt by thermal expansion in a state where the fixing belt is heated to the fixing temperature by the heating source. The first elastic part includes a small-diameter part having a smaller external diameter than a part with a maximum external diameter of the second elastic part.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
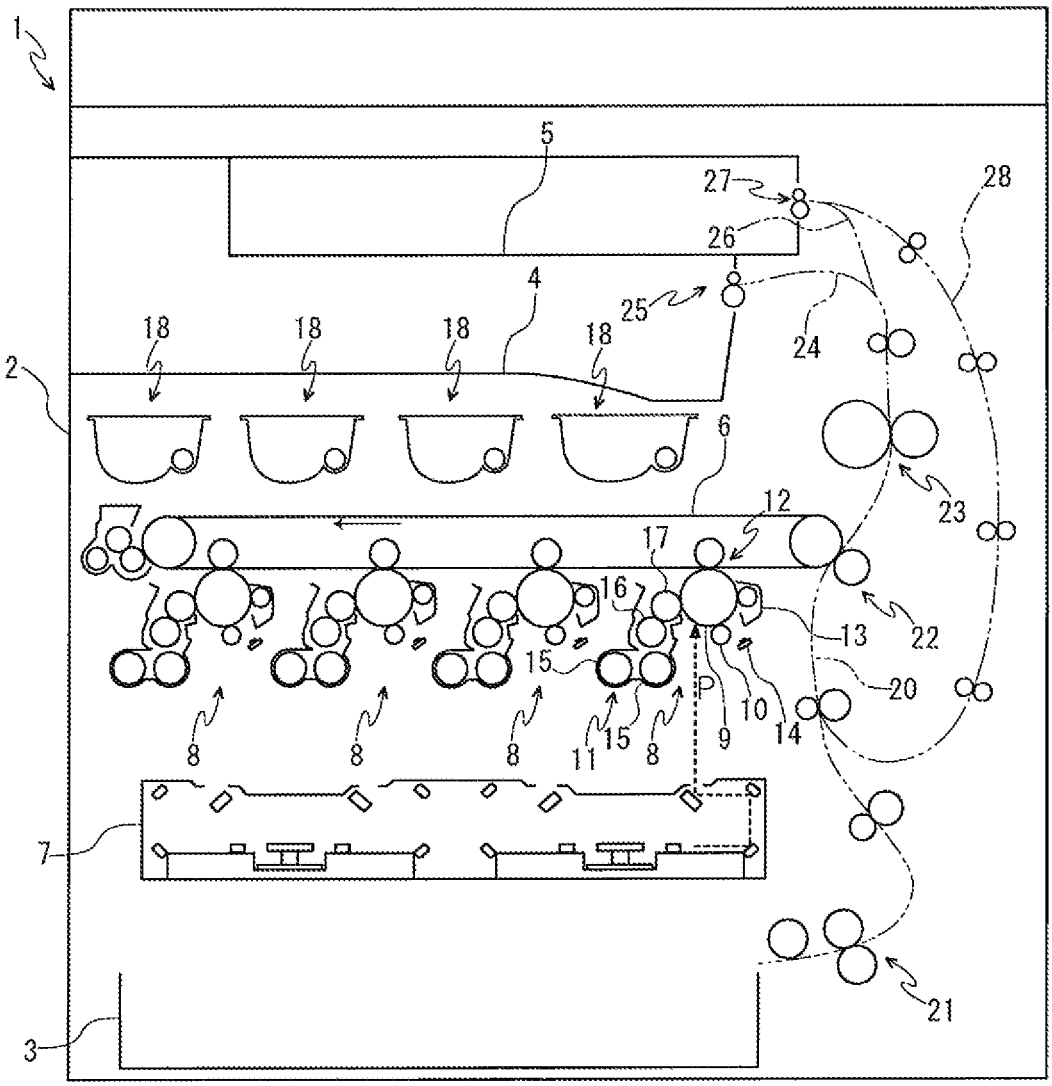
FIG. 1 is a schematic diagram schematically showing a printer according to an embodiment of the present disclosure.

With reference to FIG. 1, the entire structure of a printer 1 (an image forming apparatus) will be described. FIG. 1 is a schematic diagram schematically showing the printer according to an embodiment of the present disclosure.

The printer 1 includes a box-formed printer main body 2. In a lower part of the printer main body 2, a sheet feeding cartridge 3 to store sheets as recording mediums is installed and, in an upper part of the printer main body 2, a first sheet ejecting tray 4 is mounted. Above the first sheet ejecting tray 4, a second sheet ejecting tray 5 is mounted.

Inside of the printer main body 2, an intermediate transferring belt 6 as an image carrier is bridged over a plurality of rollers and, below the intermediate transferring belt 6, an exposure device 7 is installed. The exposure device 7 consists of a laser scanning unit (LSU). Along a lower part of the intermediate transferring belt 6, four image forming units 8 are installed for respective colors (for example, four colors of magenta, cyan, yellow, black) of toners (developers).

One of the four image forming units 8 will be described. In the image forming unit 8, a photosensitive drum 9 is rotatably attached. Around the photosensitive drum 9, a charger 10, a development device 11, a first transferring unit 12, a cleaning device 13 and a static eliminator 14 are located in order of a first transferring process.

In a lower part of the development device 11, a pair of stirring rollers 15 are installed, diagonally above of the stirring rollers 15, a magnetic roller 16 is installed and, diagonally above of the magnetic roller 16, a developing roller 17 is installed. Above the development device 11, four toner containers 18 corresponding to the image forming units 8 are installed for different colors (for example, four colors of magenta, cyan, yellow, black) of toners, respectively.

At one side (the right-hand side of the figure) in the printer main body 2, a sheet conveying path 20 is arranged in an upper and lower direction. At an upper stream end of the conveying path 20, a sheet feeder 21 is positioned. At an intermediate stream part of the conveying path 20, a second transferring unit 22 is positioned in contact with one end (a right end of the figure) of the intermediate transferring belt 6. At a lower stream part of the conveying path 20, a fixing device 23 is positioned.

The conveying path 20 branches off at its lower stream part than the fixing device 23 in the upper and lower direction. At a lower stream end of the lower branched path 24, a first sheet ejecting unit 25 is positioned above one side (above right-hand side of the figure) of the first sheet ejecting tray 4. At a lower stream end of the upper branched path 26, a second sheet ejecting unit 27 is positioned above one side (above right side of the figure) of the second sheet ejecting tray 5. The second sheet ejecting unit 27 is connected with an upper stream part in the conveying path 20 than the second transferring unit 22 via an inversion path 28 for duplex printing arranged at one side (the right-hand side of the figure) of the conveying path 20.

Next, the operation of forming an image by the printer 1 having such a configuration will be described. When the power is supplied to the printer 1, various parameters are initialized and initial determination, such as temperature determination of the fixing device 23, is carried out. Subsequently, in the printer 1, when image data is inputted and a printing start is directed from a computer or the like connected with the printer 1, image forming operation is carried out as follows.

First, the surface of the photosensitive drum 9 is electrically charged by the charger 10. Then, exposure corresponding to the image data on the photosensitive drum 9 is carried out by a laser (refer to arrow P) from the exposure device 7, thereby forming an electrostatic latent image on the surface of the photosensitive drum 9. The electrostatic latent image is developed to a toner image having a correspondent color with a toner in the development device 11. The toner image is first-transferred onto the surface of the intermediate transferring belt 6 in the first transferring unit 12. The above-mentioned operation is repeated in order by the image forming units 8, thereby forming the toner image having full color onto the intermediate transferring belt 6. Toner and electric charge remained on the photosensitive drum 9 are eliminated by the cleaning device 13 and static eliminator 14.

On the other hand, a sheet fed from the sheet feeding cartridge 3 or a manual bypass tray (not shown) by the sheet feeder 21 is conveyed to the second transferring unit 22 in a suitable timing for the above-mentioned image forming operation. Then, in the second transferring unit 22, the toner image having full color on the intermediate transferring belt 6 is second-transferred onto the sheet. The sheet with the second-transferred toner image is conveyed to a lower stream on the conveying path 20 to enter the fixing device 23, and then, the toner image is fixed on the sheet in the fixing device 23. The sheet with the fixed toner image enters the lower branched path 24 or upper branched path 26. The sheet entering the lower branched path 24 is ejected from the first sheet ejecting unit 25 onto the first sheet ejecting tray 4. The sheet entering the upper branched path 26 is ejected from the second sheet ejecting unit 27 onto the second sheet ejecting tray 5 or conveyed to the inversion path 28 for duplex printing.

Next, the fixing device 23 will be described in details with reference to FIGS. 2-5. Hereinafter, a front side (front face side) of the fixing device 23 is positioned at a foreground side of FIG. 2 for the convenience of description. In addition, an arrow Fr in FIG. 3 indicates a front side (front face side) of the fixing device 23.

Figure 2:
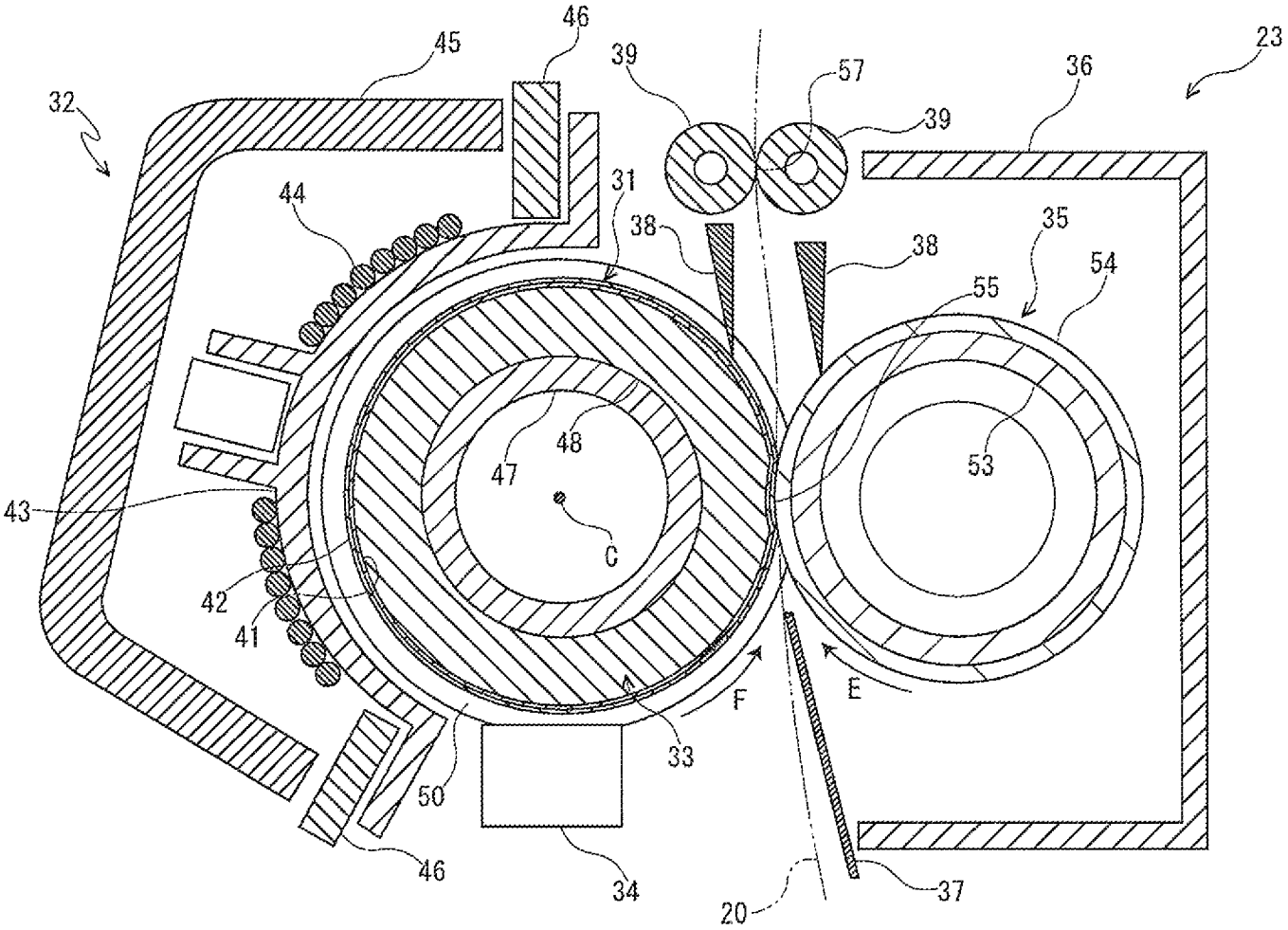
FIG. 2 is a sectional view showing a fixing device in the printer according to the embodiment of the present disclosure.

As shown in FIG. 2, the fixing device 23 includes a fixing belt 31, an IH fixing unit 32 configured to cover a left side of the fixing belt 31, a fixing roller 33 inserted in the fixing belt 31, a temperature sensor 34 provided below the fixing belt 31, a pressing roller 35 (pressing member) provided on a right of the fixing belt 31, a frame member 36 configured to cover both of front and back sides, both of upper and lower sides and a right side of the pressing roller 35, an entry guide 37 positioned on a lower left of the pressing roller 35, a pair of conveyance guides 38 positioned on an upper right of the fixing belt 31 and on an upper left of the pressing roller 35, and a pair of conveying rollers 39 positioned above the conveyance guides 38.

Figure 3:
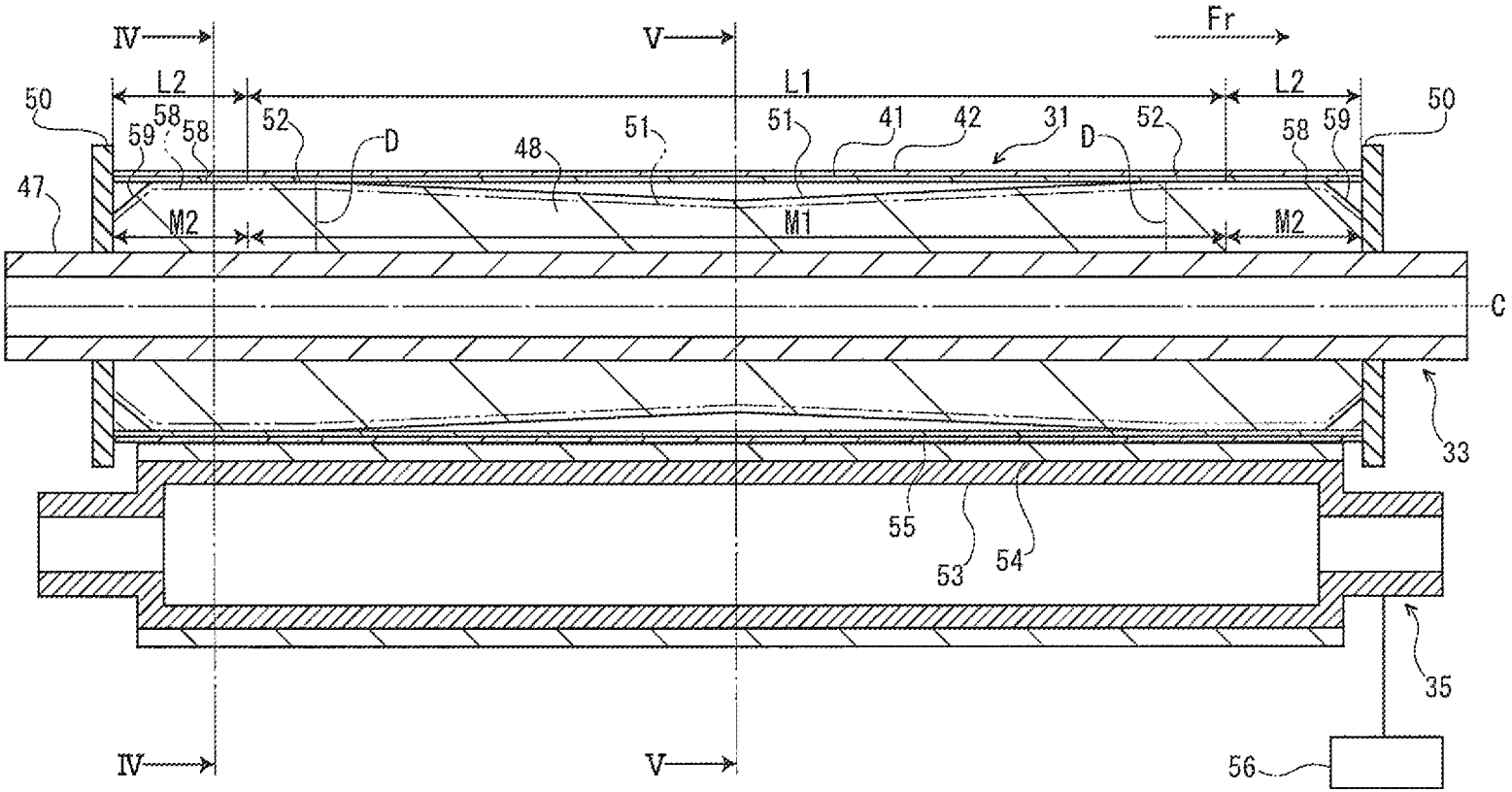
FIG. 3 is a plan sectional view showing a fixing belt, a fixing roller, and a pressing roller of the fixing device in the printer according to the embodiment of the present disclosure.

As shown in FIG. 3, the fixing belt 31 is an endless belt, and is formed in a cylindrical shape extended in forward and backward direction. The fixing belt 31 is rotatable around a rotation axis C which extends in the forward and backward direction. That is, in the present embodiment, the forward and backward direction corresponds to a rotation axis direction of the fixing belt 31.

The fixing belt 31 has, for example, a base layer (a layer closest to the inner diameter side) 41, an elastic layer 42 provided around the base layer 41 and a release layer (not shown) covering the elastic layer 42. The base layer 41 of the fixing belt 31 has a thickness of 0.04 mm, and is formed of a thin film metal sleeve made of nickel or the like. A "thin film" of the thin film metal sleeve is preferably 0.1 mm or less, is more preferably 0.06 mm or less and is still more preferably 0.05 mm or less. The elastic layer 42 of the fixing belt 31 has a thickness of 0.2 mm and is made of silicon rubber. The release layer of the fixing belt 31 has a thickness of 0.03 mm and is made of a PFA (Per Fluoro Alkoxy) tube.

As shown in FIG. 3, the fixing belt 31 is provided with a sheet passing part L1 through which a sheet (e.g. a sheet of A3 size) passes, and non-sheet passing parts L2 provided on outer sides (the front side and the back side) of the sheet passing part L1 in the forward and backward direction. In addition, inner diameters of the sheet passing part L1 and the non-sheet passing parts L2 of the fixing belt 31 are both 40 mm.

As shown in FIG. 2, the IH fixing unit 32 includes an arc-formed bobbin 43, an IH coil 44 (a heating source), an arch core 45 and side cores 46. The bobbin 43 covers the left side of the fixing belt 31. The IH coil 44 is supported on the bobbin 43 and located outside of the fixing belt 31. The arch core 45 covers the IH coil 44 and the side cores 46 are respectively located at both sides of the arch core 45. For instance, the arch core 45 and side cores 46 are made of ferrite so as to form a magnetic route through which magnetic flux created by the IH coil 44 passes.

As shown in FIG. 3, the fixing roller 33 is formed in an extended-shape in the forward and backward direction. The fixing roller 33 is configured to rotate around the rotation axis C together with the fixing belt 31.

The fixing roller 33 has a core bar 47 of a cylindrical shape and an elastic layer 48 provided around the core bar 47. In addition, two-dot chain lines in FIGS. 3, 4 and 5 indicate a position of a circumference face of the elastic layer 48 in a state where the fixing belt 31 is not heated by the IH coil 44, that is, in a state where the fixing belt 31 is at normal temperature.

The core bar 47 of the fixing roller 33 has an external diameter of 20 mm. The core bar 47 of the fixing roller 33 is made of stainless steel, such as SUS304. Pulleys 50 are fixed to both of front and back end parts of the core bar 47 of the fixing roller 33. Each pulley 50 contacts a front or a back end surface of the fixing belt 31 to restrict movement (meandering) of the fixing belt 31 in the forward and backward direction.

The elastic layer 48 of the fixing roller 33 is made of, for example, a silicon sponge. A linear expansion coefficient of the elastic layer 48 is higher than a linear expansion coefficient of the base layer 41 of the fixing belt 31. The elastic layer 48 of the fixing roller 33 is not adhered to the base layer 41 of the fixing belt 31. That is, there is no adhesive layer between the elastic layer 48 of the fixing roller 33 and the base layer 41 of the fixing belt 31.

As shown in FIG. 3, the elastic layer 48 of the fixing roller 33 is provided with a first elastic part M1 and second elastic parts M2 provided on outer sides (a front side and a backside) of the first elastic part M1 in the forward and backward direction.

The first elastic part M1 of the elastic layer 48 of the fixing roller 33 is provided on an inner diameter side of the sheet passing part L1 of the fixing belt 31. The first elastic part M1 is provided with a small-diameter part 51 and large-diameter parts 52 formed on both of front and back sides of the small-diameter part 51. In addition, lead lines D in FIG. 3 indicate boundaries between the small-diameter part 51 and the large-diameter parts 52.

The diameter of the small-diameter part 51 is reduced from both side parts toward a center part in the forward and backward direction. Across section of the small-diameter part 51 is formed linearly (tapered). Hence, the center part of the small-diameter part 51 in the forward and backward direction (a V-V sectional part in FIG. 3) has the smallest external diameter in the elastic layer 48. The external diameter of the center part of the small-diameter part 51 in the forward and backward direction is 38.5 mm in a state where the fixing belt 31 is not heated by the IH coil 44. In addition, the center part of the small-diameter part 51 in the forward and backward direction also corresponds to the center part of the entire elastic layer 48 in the forward and backward direction.

The large-diameter parts 52 are formed to have the same diameter from a front end side to a back end side. The external diameter of the large-diameter parts 52 are 39.8 mm in a state where the fixing belt 31 is not heated by the IH coil 44. Hence, the external diameter of the large-diameter parts 52 is slightly smaller than the inner diameter (40.0 mm) of the fixing belt 31.

The second elastic parts M2 of the elastic layer 48 of the fixing roller 33 are provided on an inner diameter side of the non-sheet passing parts L2 of the fixing belt 31. An inner side part 58 of each second elastic part M2 is a part with a maximum external diameter of each second elastic part M2, and is formed to have the same diameter from a front end side to a back end side. The external diameter of the inner side part 58 of each second elastic part M2 is 39.8 mm in a state where the fixing belt 31 is not heated by the IH coil 44. The external diameter of the inner side part 58 of each second elastic part M2 is larger than the external diameter of the small-diameter part 51 of the first elastic part M1. In other words, the external diameter of the small-diameter part 51 of the first elastic part M1 is smaller than the external diameter of the inner side part 58 of each second elastic part M2. The external diameter of the inner side part 58 of each second elastic part M2 is the same as the external diameter of large-diameter parts 52 of the first elastic part M1. As is obvious from this, the external diameters of both of the small-diameter part 51 and the large-diameter parts 52 of the first elastic part M1 are equal to or less than the external diameter of the inner side part 58 of each second elastic part M2. The external diameter of the inner side part 58 of each second elastic part M2 is slightly smaller than the inner diameter (40.0 mm) of the fixing belt 31. The diameter of an outer side part 59 of each second elastic part M2 is reduced toward outside in the forward and backward direction. Across section of the outer side part 59 of each second elastic part M2 is formed linearly (tapered).

As shown in FIG. 2, the temperature sensor 34 is composed of, for example, a thermistor, and is configured to detect a temperature of the fixing belt 31. The temperature sensor 34 opposes to the circumference face of the fixing belt 31 at a predetermined interval. In other words, the temperature sensor 34 is not in contact with the circumference face of the fixing belt 31.

As shown in FIG. 3, the pressing roller 35 is formed in an extended-shape in the forward and backward direction. The pressing roller 35 has an external diameter of 30 mm. The pressing roller 35 has a core bar 53 of a cylindrical shape, an elastic layer 54 provided around the core bar 53, and a release layer (not shown) covering the elastic layer 54. The core bar 53 of the pressing roller 35 has a thickness of 4.0 mm, and is made of metal, such as aluminum or the like. The elastic layer 54 of the pressing roller 35 has a thickness of 2.0 mm, and is made of silicon rubber. The release layer of the pressing roller 35 has a thickness of 0.05 mm and is made of a PFA (Per Fluoro Alkoxy) tube. The pressing roller 53 is connected to a drive source 56 composed of a motor or the like.

As shown in FIG. 2, the fixing belt 31 is nipped between the pressing roller 35 and the fixing roller 33, and a fixing nip 55 is formed between the fixing belt 31 and the pressing roller 35 along the conveying path 20 for sheets.

As shown in FIG. 2, the frame member 36 forms a box shape whose inner side (left side) is opened, and insulates the pressing roller 35 from an outside to reduce head radiation from the pressing roller 35. The frame member 36 is made of a sheet metal to reduce heat radiation to the outside as much as possible.

The entry guide 37 is located at the upper stream side of the fixing nip 55 and at the right side of the conveying path 20. The entry guide 37 extends in the upper direction slightly inclined to left. A top end of the entry guide 37 is provided adjacent to the circumference face of the pressing roller 35.

The left conveyance guide 38 is positioned on a lower stream side of the fixing nip 55 and closer to the left side than the conveying path 20. The left conveyance guide 38 may be provided with a plurality of separation pawls (not shown) which contact or approach the circumference face of the fixing belt 31. The right conveyance guide 38 is positioned on the lower stream side of the fixing nip 55 and closer to the right side than the conveying path 20, and opposes to the left conveyance guide 38 across the conveying path 20.

Each conveying roller 39 is positioned closer to the lower stream side than each conveyance guide 38. A conveying nip 57 is formed between the conveying rollers 39 along the conveying path 20 for sheets.

An operation when the toner image is fixed on the sheet in the device applying the above configuration will be described.

To fix the toner image on the sheet, the pressing roller 35 is rotated by the drive source 56 (see an arrow E in FIG. 2). When the pressing roller 35 is rotated in this way, the fixing belt 31 coming into pressure contact with the pressing roller 35 rotates in the opposite direction to the pressing roller 35 accompanying with the rotation of the pressing roller 35 (see an arrow F in FIG. 2). Accompanying with this, the fixing roller 33 also rotates integrally with the fixing belt 31. Further, a high frequency electric current is applied to the IH coil 44 to fix the toner image on the sheet. By this means, a high frequency magnetic field is produced in the IH coil 44, and this high frequency magnetic field heats the fixing belt 31 to a fixing temperature at which the toner image is fixed on the sheet. When the sheet passes through the fixing nip 55 in this state, the sheet and the toner image are heated and pressurized, and then the toner image is fixed on the sheet.

Next, thermal expansion of the elastic layer 48 of the fixing roller 33 will be described.

Figure 4:
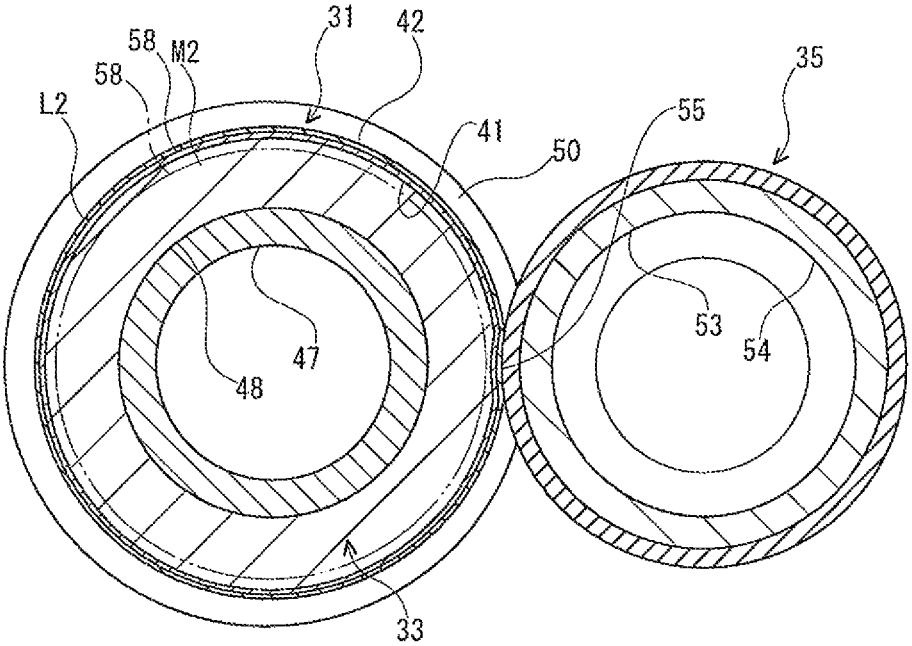
FIG. 4 is a sectional view along the line IV-IV of FIG. 3.
Figure 5:
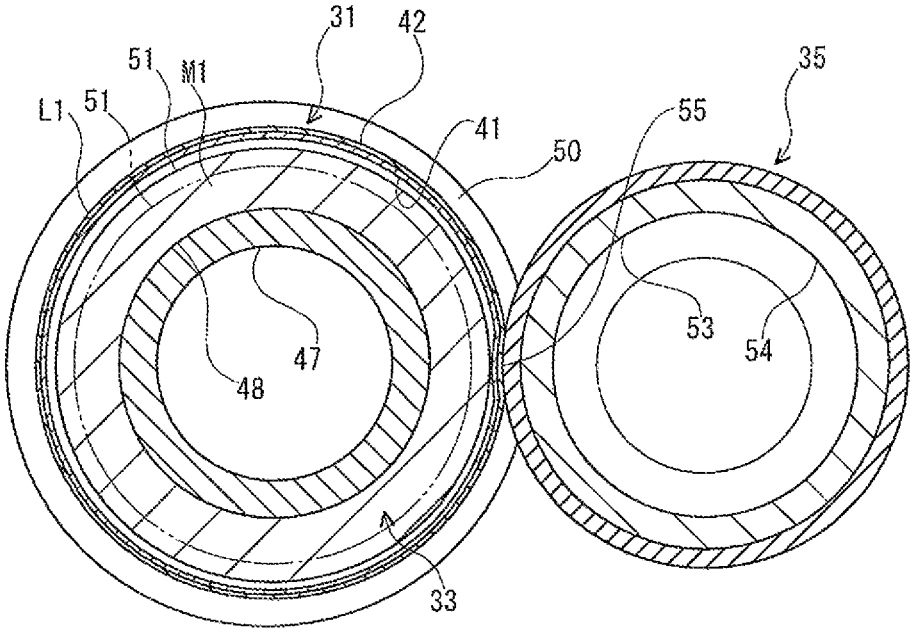
FIG. 5 is a sectional view along the line V-V of FIG. 3.

In a state where the fixing belt 31 is not heated by the IH coil 44, that is, in a state where the fixing belt 31 is at normal temperature, a gap is formed between the inner side part 58 of second elastic parts M2 of the fixing roller 33 and the non-sheet passing parts L2 of the fixing belt 31 as indicated by the two-dot chain lines in FIGS. 3 and 4. Further, as indicated by the two-dot chain lines in FIGS. 3 and 5, a gap is formed between the small-diameter part 51 of the first elastic part M1 of the fixing roller 33 and the sheet passing part L1 of the fixing belt 31.

When the fixing belt 31 is heated by the IH coil 44 from this state, the temperature of the fixing roller 33 rises and the elastic layer 48 of the fixing roller 33 thermally expands. The elastic layer 48 of the fixing roller 33 has a higher linear expansion coefficient than the linear expansion coefficient of the base layer 41 of the fixing belt 31, and then the elastic layer 48 of the fixing roller 33 more rapidly expands than the base layer 41 of the fixing belt 31 and the gap between the elastic layer 48 of the fixing roller 33 and the base layer 41 of the fixing belt 31 gradually becomes smaller. Further, when the fixing belt 31 is heated to the fixing temperature by the IH coil 44, the inner side part 58 of each second elastic part M2 of the fixing roller 33 comes into close contact with each non-sheet passing part L2 of the fixing belt 31 by thermal expansion as indicated by solid lines in FIGS. 3 and 4. Meanwhile, as indicated by the solid lines in FIGS. 3 and 5, a gap continues to be formed between the small-diameter part 51 of the first elastic part M1 of the fixing roller 33 and the sheet passing part L1 of the fixing belt 31 at a part other than the fixing nip 55.

In the present embodiment, in a state where the fixing belt 31 is not heated by the IH coil 44, a gap is formed between the inner side part 58 of each second elastic part M2 of the fixing roller 33 and each non-sheet passing part L2 of the fixing belt 31 as described above. Meanwhile, in a state where the fixing belt 31 is heated to the fixing temperature by the IH coil 44, the inner side part 58 of each second elastic part M2 of the fixing roller 33 is in close contact with each non-sheet passing part L2 of the fixing belt 31 by thermal expansion. Consequently, it is possible to support each non-sheet passing part L2 of the fixing belt 31 from the inside by the inner side part 58 of each second elastic part M2 of the fixing roller 33, and stabilize a track of the fixing belt 31. Consequently, it is possible to prevent an interval between peripheral members (e.g. the temperature sensor 34 and a thermocut) of the fixing belt 31 and the fixing belt 31 from changing and cause the peripheral members to adequately actuate. Further, it is possible to prevent the fixing belt 31 from contacting the peripheral members and to prevent the surface layer of the fixing belt 31 from being damaged. Furthermore, it is possible to make the interval between the IH coil 44 and the fixing belt 31 proper and efficiently heat the fixing belt 31.

Still further, the external diameter of the small-diameter part 51 of the first elastic part M1 of the fixing roller 33 is smaller than the external diameter of the inner side part 58 of each second elastic part M2 of the fixing roller 33, so that it is possible to prevent the inner pressure of the fixing belt 31 from rising when the elastic layer 48 of the fixing roller 33 thermally expands. Consequently, it is possible to prevent the apparent hardnesses of the fixing roller 33 and the fixing belt 31 from rising, and secure an adequate nip width without increasing the fixing pressure. Hence, it is not necessary to make the diameter of the fixing belt 31 larger to respond to the rise of the fixing pressure. Further, it is possible to reduce the stress applied to the elastic layer 48 of the fixing roller 33 in use, and, consequently, delay deterioration of the elastic layer 48 of the fixing roller 33 and set a long life cycle of the fixing roller 33.

Furthermore, a gap is formed between the small-diameter part 51 of the first elastic part M1 of the fixing roller 33 and the sheet passing part L1 of the fixing belt 31 in the state where the fixing belt 31 is heated to the fixing temperature by the IH coil 44. Consequently, it is possible to more effectively prevent the inner pressure of the fixing belt 31 from rising when the elastic layer 48 of the fixing roller 33 thermally expands.

Further, the diameter of the small-diameter part 51 of the first elastic part M1 of the fixing roller 33 is reduced from both side parts toward a center part in the forward and backward direction (the rotation axis direction of the fixing belt 31) and the cross section of the small-diameter part 51 is formed linearly (tapered). Consequently, the shape of the first elastic part M1 moderately changes, so that it is possible to make the fixing pressure uniform as much as possible. Further, by reducing the external diameter of the center part of the first elastic part M1 which is comparatively likely to deteriorate, it is possible to effectively prevent the center part of the first elastic part M1 from deteriorating.

Furthermore, the fixing belt 31 is provided with the base layer 41 which is formed with a metal sleeve, so that it is possible to increase a rigidity of the fixing belt 31 compared to the fixing belt 31 whose base layer 41 is made of resin. Consequently, it is possible to prevent the fixing belt 31 from deflecting and provide a uniform fixing pressure from one end side to the other end side of the fixing belt 31 in the rotation axis direction. Further, in the present embodiment, the base layer 41 of the fixing belt 31 in particular is formed of a thin film metal sleeve, so that it is possible to reduce the heat capacity of the fixing belt 31. Consequently, it is possible to shorten the warm-up time.

Further, in the present embodiment, the elastic layer 48 of the fixing roller 33 and the base layer 41 of the fixing belt 31 are not adhered. Consequently, it is possible to prevent heat generated in the fixing belt 31 from escaping to an adhesive layer. Consequently, it is possible to further shorten the warm-up time.

Further, the base layer 41 of the fixing belt 31 has an adequate rigidity and the fixing belt 31 is provided around the fixing roller 33 formed by fixing the elastic layer 48 on the core bar 47. Consequently, the fixing belt 31 has a good durability.

Further, the fixing roller 33 and the pressing roller 35 each have an elastic layer. Consequently, by adequately changing the hardness of the elastic layer 48 of the fixing roller 33 and the hardness of the elastic layer 54 of the pressing roller 35, the degree of freedom to select the nip width becomes high and it is possible to increase the speed of the printer 1.

Further, deflection of the pressing roller 35 in the rotation axis direction (the forward and backward direction in the present embodiment) is moderated by the elastic layer 48 of the fixing roller 33. Consequently, it is possible to keep the nip width uniformly, make a load to be applied to sheets which pass through the fixing nip 55 uniform and prevent waving or the like.

In the present embodiment, the base layer 41 of the fixing belt 31 is formed of a metal sleeve. In another embodiment, the base layer 41 of the fixing belt 31 may be made of resin, such as PI (polyimide).

Figure 6:
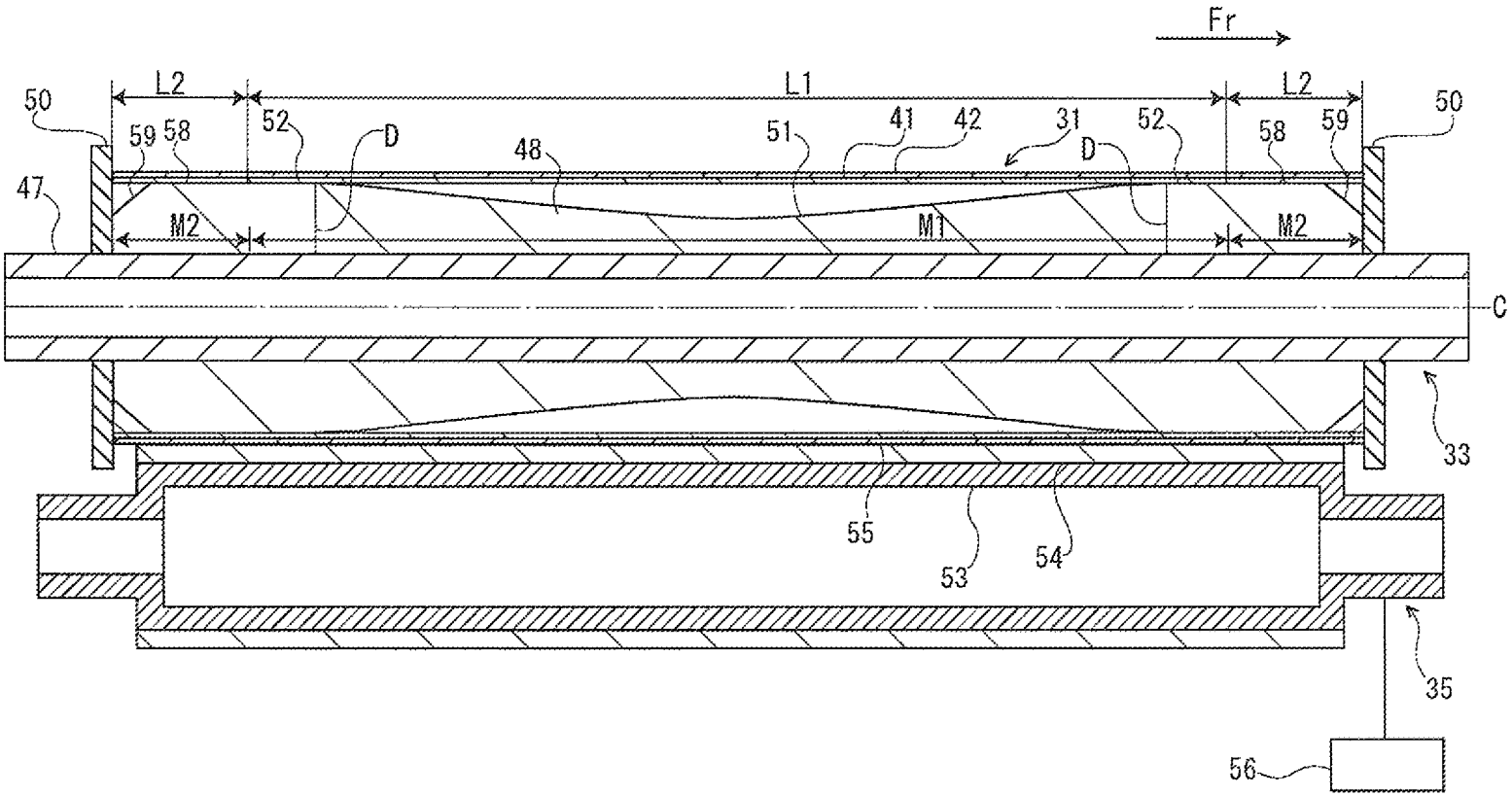
FIG. 6 is a plan sectional view showing a fixing belt, a fixing roller, and a pressing roller of the fixing device in the printer according to another embodiment of the present disclosure.

In the present embodiment, the diameter of the small-diameter part 51 of the first elastic part M1 is reduced from both side parts toward a center part in the forward and backward direction (the rotation axis direction of the fixing belt 31) and the cross section of the small-diameter part 51 is formed linearly (tapered). Meanwhile, in a further embodiment, as shown in FIG. 6, the diameter of the small-diameter part 51 of the first elastic part M1 is reduced from both side parts toward a center part in the forward and backward direction (the rotation axis direction of the fixing belt 31) and the cross section of the small-diameter part 51 may be curved in an arc shape. By applying this configuration, the shape of the first elastic part M1 moderately changes similar to the present embodiment and, consequently, it is possible to make the fixing pressure uniform as much as possible. Further, by reducing the external diameter of the center part of the first elastic part M1 which is comparatively likely to deteriorate, it is possible to effectively prevent the center part of the first elastic part M1 from deteriorating.

Figure 7:
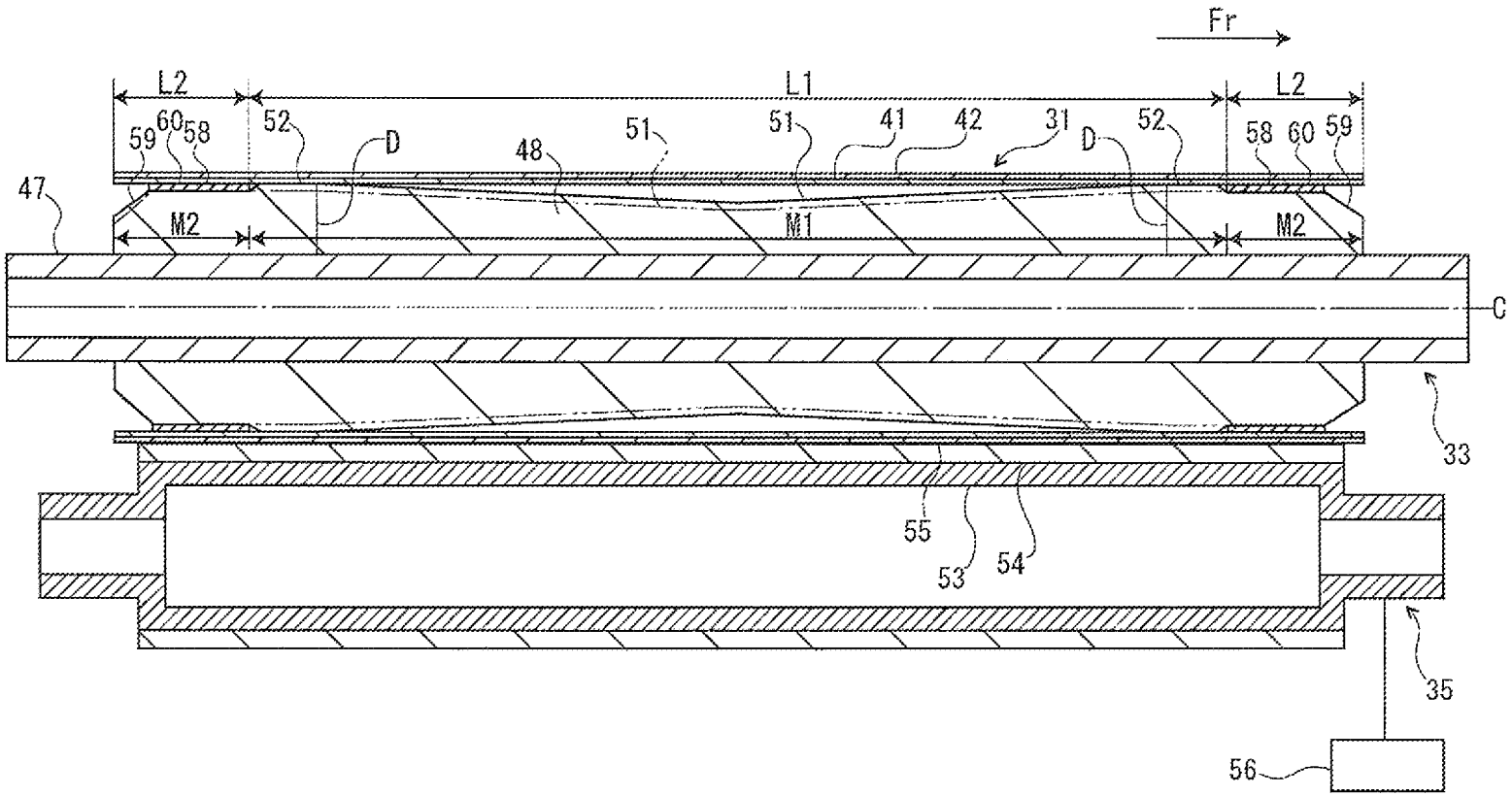
FIG. 7 is a plan sectional view showing a fixing belt, a fixing roller, and a pressing roller of the fixing device in the printer according to another embodiment of the present disclosure.
Figure 8:
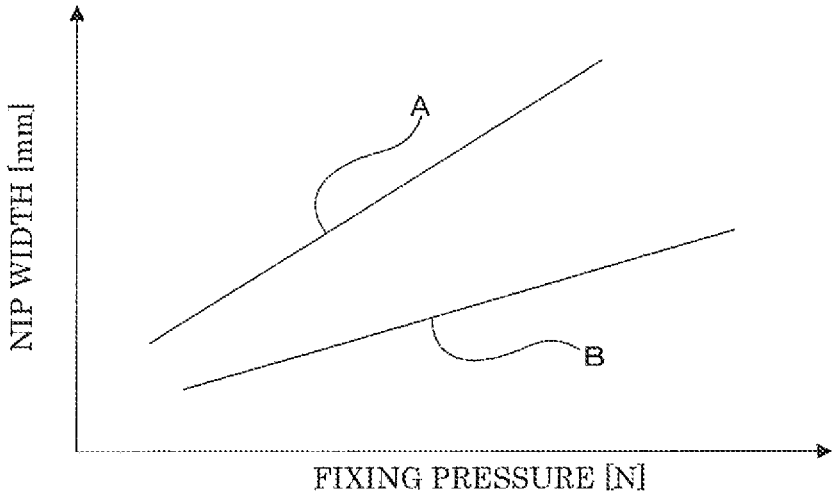
FIG. 8 is a graph showing a relationship between a fixing pressure and a nip width.

In the present embodiment, the elastic layer 48 of the fixing roller 33 and the base layer 41 of the fixing belt 31 are not adhered and meandering of the fixing belt 31 is restricted by using the pulleys 50 to reduce the heat capacity of a part to be heated by the IH coil 44 (the heating source). Meanwhile, in a furthermore embodiment, as shown in FIG. 7, at least a part of the second elastic parts M2 of the elastic layer 48 of the fixing roller 33 and the non-sheet parting parts L2 of the fixing belt 31 may be adhered by an adhesive 60. By applying this configuration, it is possible to restrict meandering of the fixing belt 31 without using, for example, the pulleys 50 and, consequently, reduce cost. Further, it is possible to reduce an influence on the sheet passing part L1 of the fixing belt 31 caused by heat escaping to the adhesive 60 compared to a case where the first elastic part M1 of the elastic layer 48 of the fixing roller 33 and the sheet passing part L1 of the fixing belt 31 are adhered.

Although not described in particular in the present embodiment, the pressing roller 35 may have a shape (a so-called "crown shape") whose external diameter gradually becomes smaller from the both end parts toward the center part of the pressing roller 35 in the rotation axis direction. By applying this configuration, it is possible to increase conveying performance of sheets.

In the present embodiment, the pressing roller 35 is used as a pressing member. In a still further embodiment, a pressing belt may be used as a pressing member.

In the present embodiment, the IH coil 44 is used as a heating source. In a still further embodiment, a heater, such as a halogen heater or a ceramic heater, may also be used as a heating source. That is, a manner to heat the fixing belt 31 by a heating source may not be induction heating.

Although the embodiment was described in a case where ideas of the disclosure are applied to the printer 1, as a furthermore embodiment, the ideas of the disclosure may be applied to another image forming apparatus except the printer 1, such as a copying machine, a facsimile or the like.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt provided rotatably and including a sheet passing part through which a recording medium passes and a non-sheet passing part provided on an outer side of the sheet passing part in a rotation axis direction of the fixing belt;

a heating source configured to heat the fixing belt to a fixing temperature at which a toner image is fixed on the recording medium; and a fixing roller inserted in the fixing belt and including an elastic layer having a higher linear expansion coefficient than a linear expansion coefficient of the fixing belt, wherein the elastic layer includes:

a first elastic part provided on an inner diameter side of the sheet passing part; and a second elastic part provided on an outer side of the first elastic part in the rotation axis direction of the fixing belt and provided on an inner diameter side of the non-sheet passing part, a gap is formed between at least a part of the elastic layer and the fixing belt in a state where the fixing belt is not heated by the heating source, and at least the part of the elastic layer is in close contact with the fixing belt by thermal expansion in a state where the fixing belt is heated to the fixing temperature by the heating source, the first elastic part includes a small-diameter part having a smaller external diameter than a part with a maximum external diameter of the second elastic part.

2. The fixing device according to claim 1, wherein a gap is formed between the small-diameter part and the sheet passing part in a state where the fixing belt is heated to the fixing temperature by the heating source.

3. The fixing device according to claim 1, wherein the diameter of the small-diameter part is reduced from both side parts toward a center part in the rotation axis direction of the fixing belt and a cross section of the small-diameter part is formed linearly.

4. The fixing device according to claim 1, wherein the diameter of the small-diameter part is reduced from both side parts toward a center part in the rotation axis direction of the fixing belt and a cross section of the small-diameter part is curved in an arc shape.

5. The fixing device according to claim 1, wherein the fixing belt includes a base layer formed of a metal sleeve.

6. The fixing device according to claim 1, wherein the elastic layer is not adhered to the fixing belt.

7. The fixing device according to claim 1, wherein at least a part of the second elastic part is adhered to the non-sheet passing part.

8. The fixing device according to claim 1, wherein the first elastic part further includes a large-diameter part formed on both sides of the small-diameter part in the rotation axis direction of the fixing belt, and the large-diameter part has a same external diameter as the part with the maximum external diameter of the second elastic part.

9. The fixing device according to claim 1, wherein the second elastic part includes an inner side part with the maximum external diameter, and a gap is formed between the inner side part and the non-sheet passing part of the fixing belt in the state where the fixing belt is not heated by the heating source, and the inner side part is in close contact with the non-sheet passing part of the fixing belt by thermal expansion in the state where the fixing belt is heated to the fixing temperature by the heating source.

10. An image forming apparatus comprising a fixing device configured to include:

a fixing belt provided rotatably and including a sheet passing part through which a recording medium passes and a non-sheet passing part provided on an outer side of the sheet passing part in a rotation axis direction of the fixing belt;

a heating source configured to heat the fixing belt to a fixing temperature at which a toner image is fixed on the recording medium; and a fixing roller inserted in the fixing belt and including an elastic layer having a higher linear expansion coefficient than a linear expansion coefficient of the fixing belt, wherein the elastic layer includes:

a first elastic part provided on an inner diameter side of the sheet passing part; and a second elastic part provided on an outer side of the first elastic part in the rotation axis direction of the fixing belt and provided on an inner diameter side of the non-sheet passing part, a gap is formed between at least a part of the elastic layer and the fixing belt in a state where the fixing belt is not heated by the heating source, and at least the part of the elastic layer is in close contact with the fixing belt by thermal expansion in a state where the fixing belt is heated to the fixing temperature by the heating source, the first elastic part includes a small-diameter part having a smaller external diameter than a part with a maximum external diameter of the second elastic part.

11. The image forming apparatus according to claim 10, wherein a gap is formed between the small-diameter part and the sheet passing part in a state where the fixing belt is heated to the fixing temperature by the heating source.

12. The image forming apparatus according to claim 10, wherein the diameter of the small-diameter part is reduced from both side parts toward a center part in the rotation axis direction of the fixing belt and a cross section of the small-diameter part is formed linearly.

13. The image forming apparatus according to claim 10, wherein the diameter of the small-diameter part is reduced from both side parts toward a center part in the rotation axis direction of the fixing belt and a cross section of the small-diameter part is curved in an arc shape.

14. The image forming apparatus according to claim 10, wherein the fixing belt includes a base layer formed of a metal sleeve.

15. The image forming apparatus according to claim 10, wherein the elastic layer is not adhered to the fixing belt.

16. The image forming apparatus according to claim 10, wherein at least apart of the second elastic part is adhered to the non-sheet passing part.

17. The image forming apparatus according to claim 10, wherein the first elastic part further includes a large-diameter part formed on both sides of the small-diameter part in the rotation axis direction of the fixing belt, and the large-diameter part has a same external diameter as the part with the maximum external diameter of the second elastic part.

18. The image forming apparatus according to claim 10, wherein the second elastic part includes an inner side part with the maximum external diameter, and a gap is formed between the inner side part and the non-sheet passing part of the fixing belt in the state where the fixing belt is not heated by the heating source, and the inner side part is in close contact with the non-sheet passing part of the fixing belt by thermal expansion in the state where the fixing belt is heated to the fixing temperature by the heating source.

* * * * *